US010022775B2

(12) United States Patent
Brechling et al.

(10) Patent No.: US 10,022,775 B2
(45) Date of Patent: Jul. 17, 2018

(54) DEVICE AND METHOD FOR FORMING HOLLOW CYLINDRICAL BODIES

(71) Applicant: SCHULER PRESSEN GMBH, Goeppingen (DE)

(72) Inventors: Carsten Brechling, Ulm (DE); Wilfried Abt, Rechberghausen (DE); Thomas Rehm, Aufhausen (DE)

(73) Assignee: SCHULER PRESSEN GMBH, Goeppingen (DE)

( * ) Notice: Subject to any disclaimer, the term of this patent is extended or adjusted under 35 U.S.C. 154(b) by 31 days.

(21) Appl. No.: 14/967,523

(22) Filed: Dec. 14, 2015

(65) Prior Publication Data

US 2016/0096216 A1 Apr. 7, 2016

Related U.S. Application Data

(63) Continuation-in-part of application No. PCT/EP2014/063544, filed on Jun. 26, 2014.

(30) Foreign Application Priority Data

Jun. 28, 2013 (DE) ..... 10 2013 106 784

(51) Int. Cl.
*B21D 51/26* (2006.01)
*B21D 43/14* (2006.01)

(52) U.S. Cl.
CPC ..... *B21D 51/2692* (2013.01); *B21D 43/14* (2013.01); *B21D 51/26* (2013.01)

(58) Field of Classification Search
CPC ..... B21D 51/26; B21D 51/2692; B21D 43/14
USPC ..... 72/20.5
See application file for complete search history.

(56) References Cited

FOREIGN PATENT DOCUMENTS

| | | | |
|---|---|---|---|
| DE | 7822648 | U1 | 11/1978 |
| DE | 10 2010 061 248 | A1 | 6/2012 |
| DE | 10 2010 061248 | A1 | 6/2012 |
| JP | A S53-126589 | | 4/1978 |
| JP | 2002 336999 | A | 11/2002 |
| JP | A 2002-336999 | | 11/2002 |
| JP | A 2010-125456 | | 6/2010 |
| JP | 2011 079058 | A | 4/2011 |
| JP | A 2012-125840 | | 7/2012 |
| JP | 3180789 | | 10/2013 |

OTHER PUBLICATIONS

Machine translation of JP 53-126589, Fukazawa, pp. 1-2, translated on Jun. 12, 2017.*

(Continued)

*Primary Examiner* — Teresa M Ekiert
(74) *Attorney, Agent, or Firm* — Ronaldo S. Lombard

(57) ABSTRACT

A device and a method for forming hollow cylindrical bodies. The device has a plurality of stations. A tool is allocated to each station. The tools are arranged on a common carrier. The tool can be moved between two reversing positions via a main drive. This reciprocating movement is executed intermittently. One of the two reversing positions forms a rest position in which the tool carrier stops in a rest phase. While the tool carrier stops in a rest position in the rest phase, a transport device transports the bodies from one station to the respective next station.

9 Claims, 3 Drawing Sheets

(56) References Cited

OTHER PUBLICATIONS

Machine translation of JP 2012-125840, Abt et al. pp. 1-6, translated on Jun. 12, 2017.*
The International Search Report of International Application No. PCT/EP2014/063544, dated Sep. 16, 2014, the corresponding international application. (2 pages).
English Translation of Notice of Reason for Rejection from the Japanese Patent Office for a corresponding Japanese application dated Jan. 17, 2017 (4 pages).
English Translation of Notice of Reasons For Rejection (4 pages) from the Japanese Patent Office for a corresponding Japanese application dated Aug. 8, 2017, also attached the Notice in Japanese.
A J-Plat Pat machine translation of the newly cited Japanese reference JP-A No. 2010-125456.
German Office Action (German Language) of the German Patent Office dated December dated Dec. 14, 2017 regarding German patent application No. 10 2013 106 784.0.
Google generated English translation of the German Examiner's substantive findings (4 pages) of the above-referenced German Office Action.

* cited by examiner

DEVICE AND METHOD FOR FORMING HOLLOW CYLINDRICAL BODIES

CROSS-REFERENCE TO RELATED APPLICATIONS

This is a continuation-in-part application of pending international application PCT/EP2014/063544 filed Jun. 26, 2014, and claiming the priority of German application No. 10 2013 106 784.0 filed Jun. 28, 2013. The said International application PCT/EP2014/063544 and German application No. 10 2013 106 784.0 are both incorporated herein by reference in their entireties as though fully set forth.

BACKGROUND OF THE INVENTION

The invention relates to a device and a method for forming hollow cylindrical bodies. For example, the bodies are disposed for the manufacture of containers of thin-walled sheet metal, for example, aerosol cans, beverage cans, tubes or the like. During this process, initially a hollow cylindrical body is produced with the use of a deep-drawing device and/or a roll ironing device, said body being closed on one axial end and open on the other axial end. This body acts as a semi-finished product for the manufacture of the container and is further formed during successive forming processes. In particular in the region of its bottom and/or the open axial end region, it is necessary to continue forming the hollow cylindrical body further. This is accomplished with the device according to the invention and the method according to the invention, respectively. For example, the device may be a necking machine.

As a rule, such necking machines comprise a plurality of stations. One station may be configured as a processing station and/or measuring station and/or inspecting station. Thus, each station is disposed for processing the hollow cylindrical body and/or for measuring or inspecting the shape or dimension. Each station comprises a tool, in which case said tool is a processing tool and/or inspecting tool and/or measuring tool, depending on whether the station is a processing station, a measuring station, a inspecting station or a combination thereof.

The tools of the stations are arranged on a common tool carrier. The tool carrier can be moved relative to a rotating part of a transport device in order to process and/or measure and/or inspect the hollow cylindrical body. The transport device with the rotating part is disposed to move the hollow cylindrical body from one station to the next station. Appropriate holding means for the body are provided on the rotating part. The rotating part is moved intermittently, so that the bodies, respectively, move from one station to the next station. Publication DE 10 2010 061 248 A1 suggests that a rotary drive be provided for the rotating movement and that a dedicated main drive be provided for the reciprocating movement of the tool carrier relative to the rotating part. A sinusoidal reciprocating movement is generated via the main drive, for example with the use of an eccentric drive. If uncoupled from this reciprocating movement, the rotary drive of the bodies from one station to the next can be very rapid, thus increasing the effective reciprocating portion of the reciprocating movement of the tool carrier.

Considering this known device and this known method, respectively, the object of the present invention may be viewed to be the provision of another possibility for improving the flexibility of the device and the method, respectively. In doing so, it is to be made possible, in particular, to increase the maximum height of the machinable hollow cylindrical bodies with the same available maximum stroke of the tool carrier.

SUMMARY OF THE INVENTION

The invention relates to a device 10 for forming hollow cylindrical bodies 11. The device has a plurality of stations 12. A tool 13 is allocated to each station. The tools 13 are arranged on a common tool carrier 14. The tool carrier 14 can be moved between two reversing positions UA, UB via a main drive 15. This reciprocating movement H is executed intermittently. One of the two reversing positions forms a rest position in which the tool carrier 14 stops in a rest phase R. While the tool carrier 14 occupies the rest position UA in the rest phase R, a transport device 23 transports the bodies 11 from one station 12 to the respective next station 12.

In the case of the invention, there is provided a main drive for generating an intermittent reciprocating movement of the tool carrier between to reversing positions. The movement of the tool carrier is specifically not sinusoidal or cosinusoidal but, in accordance with the invention, includes a rest phase when the tool carrier is in a rest position.

The transport device with the rotating part comprises a separate rotary drive for generating an intermittent rotary movement of the rotating part. The bodies are moved intermittently, as it were, from station to station via the rotating part. The rotating movement of the rotating part occurs as long as the tool carrier is stopped in its rest position during the rest phase. Preferably, the rest position corresponds to a reversing position during the reciprocating movement of the tool carrier. Consequently, it is possible to make available almost the entire reciprocating movement as the effective stroke for forming a hollow cylindrical body. With the same length of stroke, it is possible with the inventive embodiment of the device and the inventive method, respectively, to process a body with greater axial height than with devices, wherein the reciprocating movement and the movement of the rotating part are interdependent due to mechanical coupling. It is also possible to optionally reduce the length of stroke between the two reversing positions or to adapt the axial height of the bodies. The device and the method, respectively, are thus flexible and efficient. Likewise, the velocities or accelerations during the working movement of the tool carrier out of its rest position in the direction toward the rotating part can be decreased.

Depending on the maximum possible rotational speed or rotational acceleration of the rotational movement of the rotating part, it is also possible in accordance with the invention to achieve a high reciprocating speed and thus a high output even for axially relatively high bodies.

Furthermore, it is possible to incrementally vary the reciprocating movement and/or the stroke speed and/or the stroke acceleration and/or the acceleration change of the stroke acceleration for the different phases of movement, as a result of which, for example, the movement of the tools can be adapted to the processing or measuring or inspecting operation. For example, the working stroke of the tool carrier out of the rest position toward the rotating part can be made slower and/or be performed at lower accelerations than the reverse stroke back into the rest position.

The duration of the rest phase while the tool carrier is stopped can be variably specified and/or changed. As a result of this, it is also possible to perform the transfer movement or the rotating movement of the rotating part at lower rotational speeds, lower rotational accelerations and/or smaller acceleration changes when a careful transport of the bodies is advantageous or necessary.

With the device according to the invention it is further possible to change the number of stations without structural changes of the main drive and the rotary drive.

The main drive, as well as the rotary drive, preferably comprise an electric motor for generating the movement, in particular a servomotor, a torque motor or a segment motor. In doing so, transmission elements, in particular gear transmission elements, may be omitted completely. Consequently, the mechanical wear during operation can be reduced. It is also possible to adapt deviations of components of the device during their manufacture, or during the assembly of the device, by controlling and being able to exactly position the turntable by means of the rotary drive, whereby malfunctions or errors in processing the hollow cylindrical bodies during the operation of the device can be minimized or precluded.

Preferably, the rotary drive comprises an electric motor, for example, a segment motor, torque motor or servomotor, that is connected to the rotating part without the interposition of transmission gearing or reduction gearing. As a result of this, a particularly low-wear device can be attained.

Furthermore, it is advantageous if the length of stroke between the two reversing positions is adjustable. For example, an electric motor of the main drive cannot be moved completely rotating about its axis of rotation but pivoting between a first angle of rotation representing a first pivot position and a second angle of rotation representing a second pivot position within the thusly delimited angular or pivot range. As a result of this, the length of stroke can be varied in a simple manner in that the pivot range or angle range is changed. It is also possible to separately adjust the relative positions of the reversing positions of the reciprocating movement of the tool carrier relative to the rotating part. The flexibility of the device is thus enhanced even more.

In a preferred exemplary embodiment the chronological progress of the rotating movement and the chronological progress of the reciprocating movement are separately specified. For example, the start of the rotating movement and/or the end of the rotating movement need not chronologically coincide with the start of the rest phase or the end of the rest phase. The invention simply provides that the rotating movement take place chronologically during the rest phase.

In one advantageous embodiment, the transport device comprises a position sensor that is disposed to detect the rotational position of the rotating part. For example, via the position sensor, it is possible to generate, for example, a signal that indicates the end of the rotating movement, whereupon the rest phase is ended and the reciprocating movement of the tool carrier can be continued. Via the position sensor, it is possible to position the bodies arranged on the rotating part for processing or inspecting or high-precision measuring in each station. Preferably the position of the turntable is controlled. Furthermore, it is possible to control or set the angular velocity and/or the angular acceleration and/or the acceleration change of the angular acceleration and/or the acceleration change of the angular acceleration of the rotating part.

The duration of the rest phase during which the tool carrier is stopped in its rest position is preferably adjustable and/or specifiable. Additionally or alternatively, it is also possible to adjust and/or specify the duration of the transport phase that is required by the rotary drive for rotating the rotating part between two successive rotational positions. The rest phase is at least as long as the transport phase. Due to the adjustability or specifiability of the duration of the transport phase and/or the rest phase, it is possible to flexibly adapt the device and the inventive method, respectively, to the respective work task.

BRIEF DESCRIPTION OF THE DRAWINGS

Advantageous embodiments of the device and the method, respectively, in accordance with the invention can be inferred from the claims, as well as the description. The description is restricted to essential features of the invention. The drawings are to be used for supplementary reference. Hereinafter, preferred embodiments of the invention are explained in detail with reference to the appended drawings. As shown in:

DETAILED DESCRIPTION OF THE INVENTION

Figure 1:
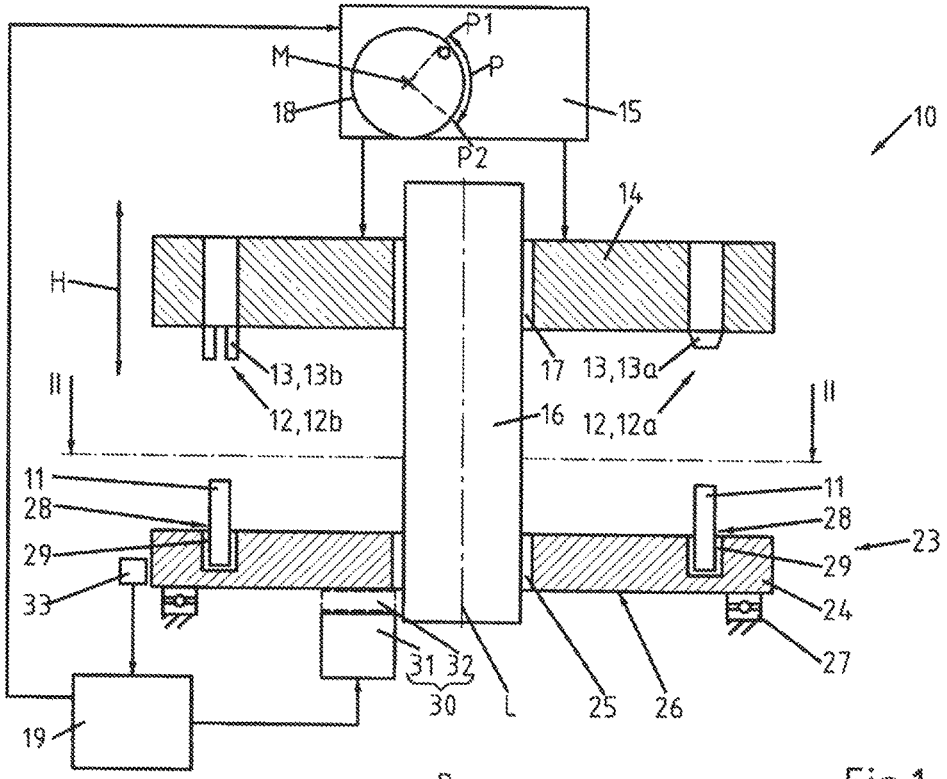
FIG. 1 a schematic side view, in section, of a first exemplary embodiment of the device according to the invention.
Figure 2:
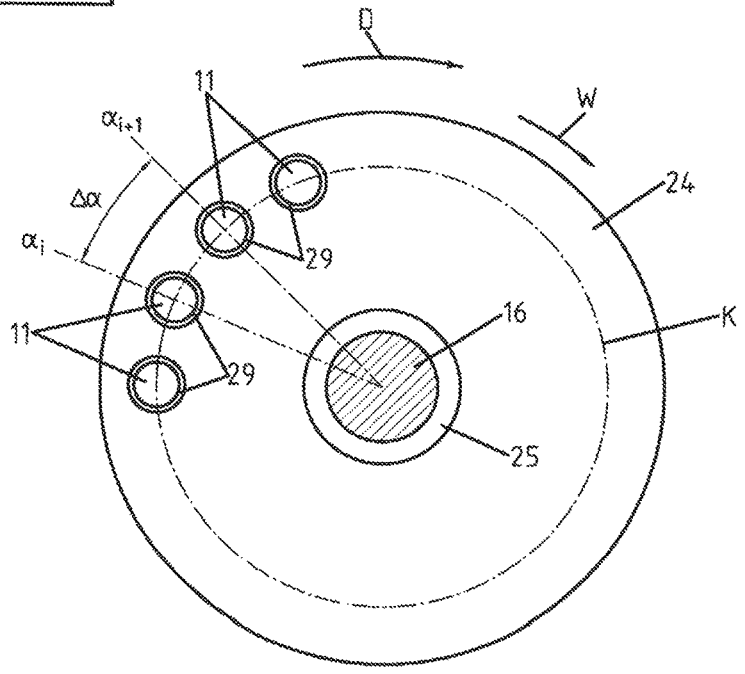
FIG. 2 a plan view, along line II-II in FIG. 1, of the rotating part of the device as in FIG. 1.

FIG. 1 shows a device 10 for forming hollow cylindrical bodies 11. The hollow cylindrical bodies 11 have been manufactured of a thin-walled sheet metal in a preceding process by deep-drawing and/or roll-ironing. These bodies are closed on one axial end, while the other axial end is open. The hollow cylindrical bodies 11 consist of a uniform material and are preferably made in one piece without seams or joints. On the inside, and/or on the outside, they may be coated with a layer of plastic material. The device 10 is disposed for further forming these hollow cylindrical bodies 11. In particular, one of the two axial end regions, for example the open axial end region, of the hollow cylindrical body 11 is formed in such a manner that its diameter is changed. Consequently, the exemplary embodiment of the device 10 represents a necking machine.

The device 10 comprises several stations 12. The stations 12 may be configured as processing stations 12*a* or as inspecting or measuring stations 12*b*. The processing station 12*a* comprises a processing tool 13*a*. Accordingly, a measuring or inspecting station 12*b* comprises a measuring or inspecting tool 13*b*. Hereinafter, the processing tools 13*a* and the measuring or inspecting tools 13*b* are referred to as tools 13.

The tools 13 are arranged on an orbit about a central longitudinal axis L. Each station 12 is allocated at least one tool 13. The stations 12 having the tools 13 are preferably uniformly arranged in circumferential direction about the longitudinal axis L.

The device 10 comprises a tool carrier 14 on which the tools 13 are arranged. The tool carrier 14 is arranged so as to be movable parallel to the longitudinal axis L. Consequently, the tool carrier 14 with the tools 13 can perform a reciprocating movement H between a first reversing point UA and a second reversing point UB. To accomplish this, the tool carrier 14 is driven by a main drive 15. Thus, the tool carrier 14, in accordance with the example is movably guided in a sliding manner along a guide column 16. The guide column 16 is arranged coaxially relative to the longitudinal axis L. In the exemplary embodiment there is provided for bearing the tool carrier 14 shown in FIG. 1, a first bearing 17 on the guide column 16, said bearing potentially being configured as a sliding bearing or a rolling bearing.

The main drive 15 comprises an electric motor and, in the exemplary embodiment, a first servomotor 18. The main drive 15 may be configured, for example, as an eccentric drive or, alternatively, as a toggle lever drive or the like. In doing so, the first servomotor 18 is connected to the tool carrier 14 via the appropriate gearing of the main drive 15. The first servomotor 18 can now be driven not only rotating about its motor axis of rotation M; it is also possible to drive the servomotor 18 in a pivoting manner in a pivot range P between a first pivot position P1 and a second pivot position P2 in an oscillating manner. In doing so, the servomotor 18 does not move so as to completely rotate about its motor axis of rotation M but reverses its direction of rotation in the pivot positions P1, P2, respectively, so that it moves in an oscillating manner between these two pivot positions P1, P2. The reciprocating movement H of the tool carrier 14 is performed accordingly via the movement of the servomotor 18. For controlling the reciprocating movement H, the main drive 15 is actuated by a control unit 19.

A transport device 23 is disposed for transporting the bodies 11 between the stations 12. Furthermore, the transport device 23 is disposed for positioning the bodies 11 in the respective stations 12, so that the bodies 11 occupy a respectively specified position opposite the tools 13. The transport device 23 comprises a rotating part 24 that is rotatably supported relative to the tool carrier 14. In the exemplary embodiment, the rotating part 24 is rotatably supported by the central column 16 via a second bearing 25 that may be configured as a sliding bearing or a rolling bearing. As an alternative to this second bearing 25, or in addition thereto, the rotating part 24 may be rotatably carried or supported on the rear side 26 of the tool carrier 14 by means of a third bearing 27, as is schematically shown by FIG. 1.

For each body 11 that is to be held, the rotating part 24 or the transport device 23 comprises a holding means 28. The holding means 28 are arranged on the side facing the tool carrier 14, for example in an orbit K about the longitudinal axis L. The diameter of the orbit K is preferably the same size as the diameter of the orbit on which the tools 13 are arranged. For example, a holding means 28 has a receiving depression 29 that receives an axial region, preferably the closed region of the body 11. Not illustrated clamping means, for example clamping jaws, may be provided in the receiving depression 29 in order to hold or clamp the body 11 in place in the desired position in the receiving depression 29. It is understood that the holding means 28 may also be configured in a manner different than is provided in the preferred exemplary embodiment.

Via the transport device 23 and the rotating part 24, respectively, it is possible to sequentially transport the bodies 11 from one station to the next station 12. In the exemplary embodiment, the rotating part 24 has a circular, circle-shaped or ring-shaped design and can thus also be referred to as a turning disk, turning ring or turntable. The transport device 23 comprises a rotary drive 30 for rotating the rotating part 24

The rotary drive 30 is controlled by the control unit 19. The rotary drive 30 is designed as a separate drive and can be actuated independently of the main drive 15. Consequently, the rotating movement of the rotating part 24 can be configured so as to be mechanically uncoupled from the reciprocating movement H of the tool part 14. Preferably, the rotary drive 30 is configured as a direct drive and comprises an electric motor 31, preferably a servomotor or segment motor, that can be connected directly to the rotating part 24 without the interposition of a mechanical transmission. As an alternative to this preferred embodiment, it is also possible to interpose a transmission 32 for mechanical coupling between the electric motor 31 of the rotary drive 30 and the rotating part 24.

The rotating part 24 is intermittently advanced in one direction of rotation D about the longitudinal axis L between respectively successive positions of rotation $\alpha_i$ and $\alpha_{i+2}$. The number of these positions of rotation $\alpha_i$ (i=1 to n) corresponds to the number n of stations 12 on the tool holder. The holding means 28 are arranged regularly along the orbit K. As a result of this, the rotating part 24 is advanced in the direction of rotation by an angle of rotation $\Delta\alpha$ between two successive positions of rotation. In doing so, the rotating part 24 moves at an angular velocity $\omega$.

Furthermore, the device 10 has a position sensor 33. The sensor signal of the position sensor 33 is transmitted to the control unit 19. Consequently, the control unit 19 can control the position of rotation $\alpha_i$ of the rotating part 24.

The chronological progression of the rotating movement of the rotating part 24 and the chronological progression of the reciprocating movement H of the tool carrier 14 can be independently specified or adjusted. This is possible because no mechanical, rigid coupling exists between the tool 14 and the main drive 15, on the one hand, and the rotating part 24 and the rotary drive 30, on the other hand. Hereinafter, the coordination and movement of the tool carrier 14 and the rotating part 25 will be explained with reference to FIGS. 5 and 6.

The device 10 can perform movement processes as a function of a time t or as a function of a higher-order guide angle $\beta$. Such a guide angle $\beta$ can be used for the coordination of the movements of several different machines or presses or transfer systems and the like. The movement progressions can thus be represented without restriction of generality as a function of the guide angle $\beta$, as shown in FIGS. 5 and 6.

Figure 5:
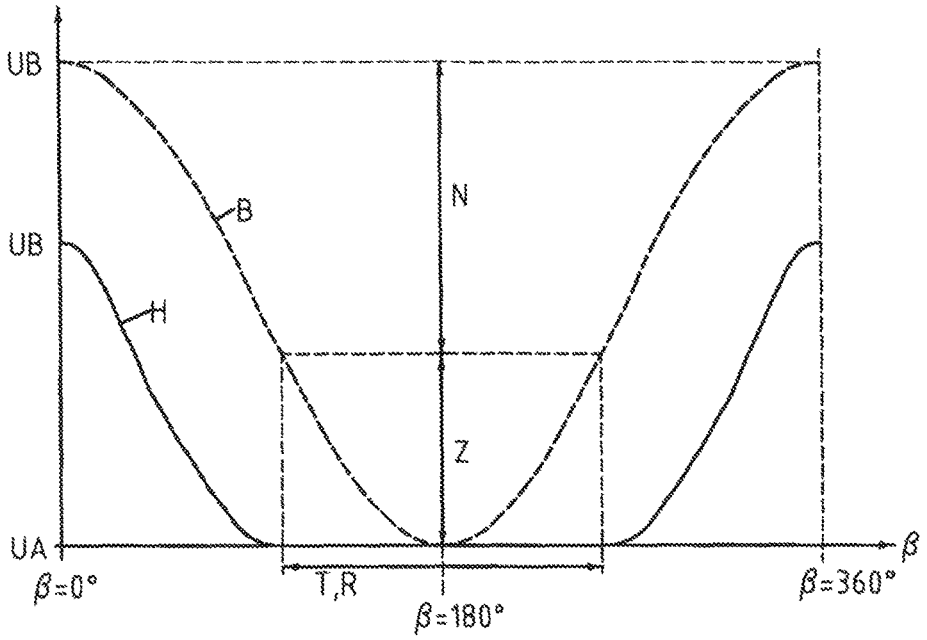
FIG. 5 a schematic representation of the progression of the reciprocating movement of the tool carrier according to the present invention in solid lines, as well as the progression of the reciprocating movement in prior art in dashed lines; and, FIG. 6 a schematic side view of the chronological progression of the reciprocating movement of the tool carrier with rest phases of different lengths.
Figure 6:
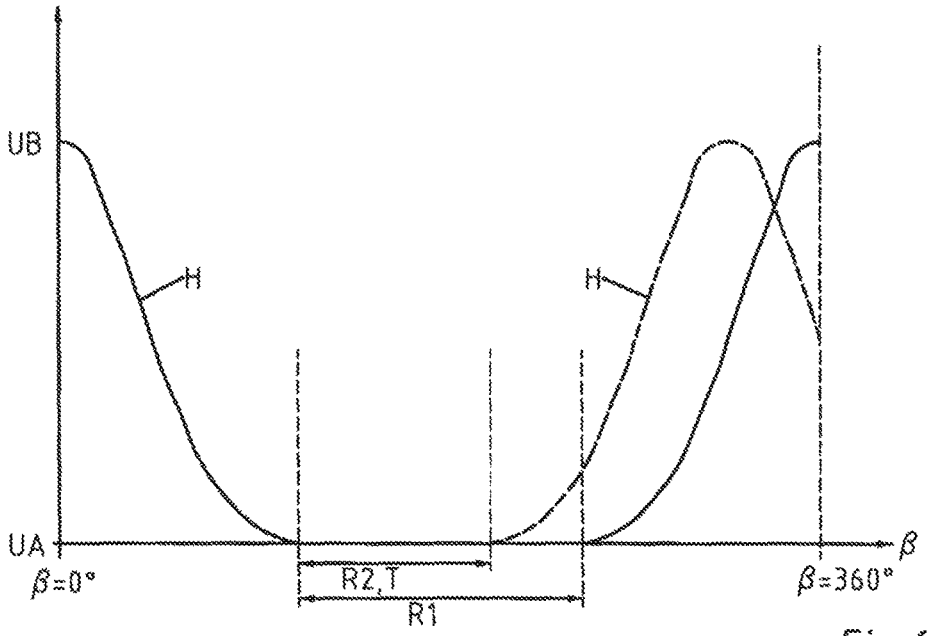

FIG. 5 shows a progression of movement B as a function of the guide angle $\beta$ in dashed lines. This progression of movement B is consistent with a prior art device. There, the tool carrier 14 is moved sinusoidally or cosinusoidally continuously between the first reversing position UA and the second reversing position UB. In the first reversing position UA, the tool carrier 14 is at a greater distance from the rotating part 24 than in the second reversing position UB.

The transfer movement between two successive positions of rotation $\alpha_i$ and $\alpha_{i+1}$, namely the movement of rotation of the rotating part 24 about the angle of rotation $\Delta\alpha$ requires a time that is referred to as the transport phase T. During this transport phase T, no other tool 13 must be in contact or in engagement with the allocated body 11 because, otherwise, a rotation of the rotating part 24 with all hollow cylindrical bodies 11 is not possible without collisions. As shown in FIG. 5, during the movement B of the tool carrier in accordance with prior art the reciprocating movement is also continued during the transport phase T, so that an overlift Z occurs during the transport phase T. The total length of stroke available between the two reversing positions UA and UB, minus the overlift Z, forms the available effective stroke N for forming the body. From FIG. 1 it can be inferred that the overlift Z accounts for a considerable portion of the total length of stroke and that for the effective stroke N only approximately 60% to 80% of the total length of stroke are available.

Therefore, in accordance with the invention, the main drive 15 is operated intermittently. In order to achieve the desired effective stroke N, the total length of stroke can be reduced, as is illustrated by a solid line in FIG. 5. In so doing, the required overlift Z is considerably reduced. In accordance with the invention this is achieved in that the reciprocating movement of the tool carrier 14 includes a rest phase R, during which the tool carrier 14 is in a rest position. In the exemplary embodiment, the rest position corresponds to the first reversing position UA. During the rest phase R, the tool carrier rests. During this rest phase R when the tool carrier 14 is in its rest position, the rotary drive 30 executes the rotating movement of the rotating part 24. As soon as the bodies 11 have been moved between the two successive stations 12, the control unit 19 initiates—via the main drive 15—a movement of the tool carrier 14 out of the rest position UA up to the second reversing position UB and back again to the first reversing position or rest position UA. This process is cyclically repeated as indicated by a solid line in FIG. 5.

The length of stroke between the two reversing positions UA, UB can be varied very easily in accordance with the invention. By changing the pivot range P with a pivoting, oscillating drive of the servomotor 18 of the main drive 15 between the two pivot positions P1, P2, the length of stroke can be adjusted consistent with the pivot range P. Likewise, the two reversing positions UA, UB can be adjusted separate from each other by changing the two pivot positions P1, P2. As a result of this, an extremely highly flexible device 10 is achieved.

By uncoupling the reciprocating movement H of the tool carrier 14 from the rotating movement of the rotating part 24, the transport phase T may also be shorter than the rest phase R. However, as a rule, the rest phase R can also be reduced by shortening the transport phase T, without reducing the length of stroke between the two reversing positions UA, UB (FIG. 6). As a result of this, the reciprocating speed and thus the output of the device can be increased. FIG. 6 shows as an example that, by reducing the duration of the transport phase T, the rest phase R can be reduced correspondingly from a first time duration value R1 to a second time duration value R2, so that—with the same length of stroke—a greater reciprocating speed can be made possible.

Figure 3:
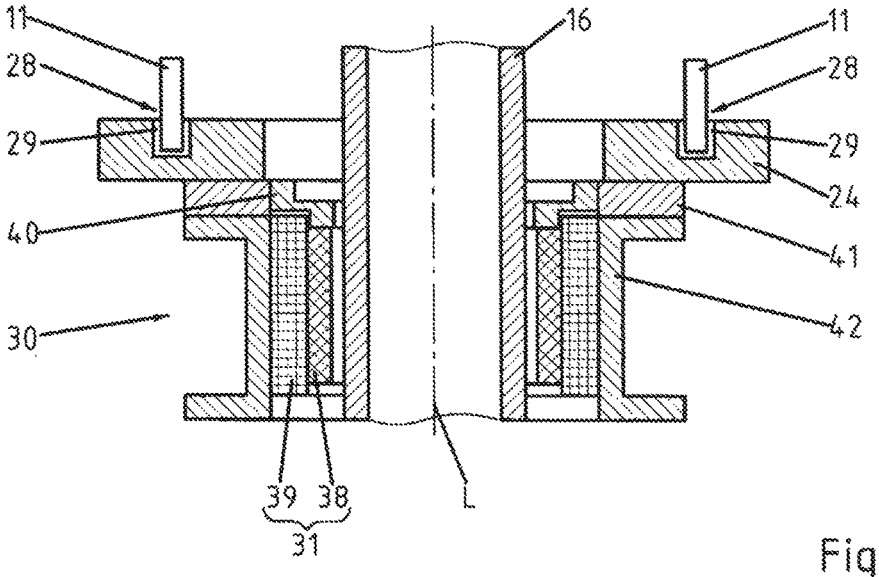
FIG. 3 a schematic side view, in section, of an exemplary embodiment for a rotary drive of the device as in FIGS. 1 and 2 for driving the rotating part.

FIG. 3 shows an exemplary embodiment of the rotary drive 30. In this case, the electric motor 31 is directly coupled to the rotating part 24, without interposing a transmission. The electric motor 31 has a rotor 38 and a stator 39. The rotor 38, as well as the stator 39, are arranged coaxially about the longitudinal axis L, in the example. In doing so, the rotor 38 is connected in a torque-proof manner to the rotating part 24 via a connecting piece 40. In the exemplary embodiment according to FIG. 3, the connecting piece 40 has the form of a stepped ring part, however, in modification thereof, it may also have any other desired form. In accordance with the example, the connecting piece 40 extends over a face-side end of the stator 39 and extends into this section radially toward the outside over the face-side of the stator 39. Coaxially with respect to the connecting piece 40, there is arranged a swivel bearing 41 via which the rotating part 24 is supported by a support part 42. In the exemplary embodiment, the support part 42 has essentially a tubular shape and is arranged coaxially around the electric motor 31. In accordance with the example, the stator 39 is mounted to the support part 42.

The electric motor 31 is configured as a hollow shaft motor, so that a cylindrical free space is created on the inside, through which space the guide column 16 can be inserted. This free space, for example, is also suitable for the insertion of driving elements, electrical lines or other supply lines. Also, a drive connecting rod can be passed through this free space in order to generate the reciprocal movement H of the tool carrier 14.

Figure 4:
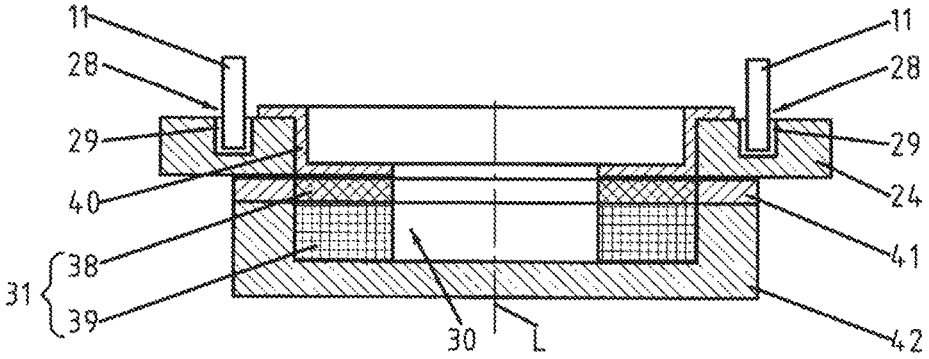
FIG. 4 a schematic side view, in section, of another exemplary embodiment of a rotary drive for the rotating part.

FIG. 4 shows a modified exemplary embodiment of a rotary drive 30. In doing so, the electric motor 31 is a so-called segment motor. In this embodiment, large diameters for the tool carrier 14 and the rotating part 21, respectively, can be achieved, so that the number of stations 12 along the orbit K can be increased. Consistent with the increased number of stations 12, it is also possible with the device 10 to execute more complex forming presses with many individual process steps and/or inspection and measuring steps.

This segment motor comprises a permanently excited disk-shaped rotor 38. The rotor 38 of the segment motor has several pole pairs, each with oppositely magnetized permanent magnets. In doing so, the magnetizing direction may be radial or tangential to the direction of rotation of the rotor 38. The stator 39 has a different, specifically smaller, number of poles, each being formed by an electromagnet. As an alternative to the depicted embodiment, the segment motor may also have a stator 39 arranged coaxially around the rotor 38. In the exemplary embodiment shown here, the stator 39 adjoins the rotor 38 in axial direction parallel to the longitudinal axis L. As in the previous exemplary embodiment of FIG. 3, it is mounted to the support part 42. In this exemplary embodiment, the rotor 38 is directly connected to the swivel bearing 41. Furthermore, the rotor 38 is coupled in a torque-proof manner with the rotating part 24 via the connecting piece 40.

In all exemplary embodiments of the device 10, the longitudinal axis L may be arranged vertically or horizontally.

The present invention also provides a method for operating the device (10) for forming the hollow cylindrical bodies (11). The device (10) as previously stated comprises the common tool carrier (14) with the plurality of stations (12) that are arranged along a circular orbit and comprise, respectively, one tool (13), wherein the tools (13) are arranged on the common tool carrier (14). The main drive (15) is in operative arrangement with the common tool carrier (14). The transport device (23) includes the rotating part (24). The separate rotary drive (30) is in operative arrangement with the rotating part (24).

The method of the present invention comprises the following steps:

initiating the intermittent reciprocating movement (H) of the tool carrier (14) between two reversing points (UA, UB), transporting the hollow cylindrical bodies (11) by the rotating part (24) between the stations (12) along a circular orbit (K), moving the tool carrier (14) into a rest position (UA) via the main drive (15) before starting of the intermittent rotating movement of the rotating part (24) and stopping the tool carrier (14) in the rest position (UA), subsequently, initiating the intermittent rotating movement of the rotating part (24) via the rotary drive (30), and, starting the reciprocating movement (H) of the tool carrier (14) out of the rest position (UA) only after the intermittent rotating movement of the rotating part (24) is completed.

LIST OF REFERENCE SIGNS

10 Device
11 Body
12 Station
12*a* Processing Station
12*b* Inspecting and measuring station
13 Tool
13*a* Processing tool
13*b* Measuring or inspecting tool
14 Tool carrier
15 Main drive
16 Guide column
17 First bearing
18 First servomotor
19 Control Unit
23 Transport device
24 Rotating part
25 Second bearing
26 Rear side
27 Third bearing
28 Holding means
29 Receiving depressions
30 Rotary drive
31 Electric motor
32 Transmission
33 Position sensor
38 Rotor
39 Stator
40 Connecting piece
41 Swivel bearing
41 Support part
$\Delta\alpha$ Angle of rotation
$\alpha i$ Position of rotation
$\omega$ Angular velocity
D Direction of rotation
H Reciprocating movement
K Orbit
M Motor axis of rotation
N Effective stroke
P Pivot range
P1 First pivot position
P2 Second pivot position
R Rest phase
R1 First time duration value for the rest phase
R2 Second time duration value for the rest phase
T Transport phase
UA First reversing point
UB Second reversing point
Z Overlift

What is claimed is:

1. A device (10) for forming hollow cylindrical bodies (11), the device (10) comprises:

a common tool carrier (14) including a plurality of stations (12) in operative arrangement along a circular orbit and comprise, respectively, one tool (13), wherein the tools (13) are in operative arrangement on the common tool carrier (14), a main drive (15) in operative arrangement with the common tool carrier (14) for generating an intermittent reciprocating movement (H) of the common tool carrier (14) between a first reversing position or rest position (UA) and a second reversing position (UB) thereof, the main drive (15) comprises a first electric motor or servomotor (18) that reverses its turning direction in the first reversing position or rest position (UA), a transport device (23) in operative arrangement with the common tool carrier (14), the transport device (23) operatively disposed for transporting the hollow cylindrical bodies (11) between the stations (12) and comprises a rotating part (24) with a plurality of holding means (28) for respectively holding one of the hollow cylindrical bodies (11) arranged along an orbit (K), the transport device (23) comprising a separate rotary drive (30) in operative arrangement with the rotating part (24) for generating an intermittent movement of rotation of the rotating part (24), a control unit (19) in operative arrangement with the main drive (15) and the separate rotary drive (30), the control unit (19) disposed to control the main drive (15) and the rotary drive (30) in such a manner that the intermittent movement of rotation of the rotating part (24) is performed as long as the tool carrier (14) is stopped in one of the reversing positions that is the rest position (UA), the control unit (19) is further disposed to adjust a length of stroke of the common tool carrier (14) between the first reversing position or rest position (UA) and the second reversing position (UB), and, the control unit (19) is further disposed to control the first electric motor or servomotor (18) of the main drive (15) in a pivot operation, wherein the main drive (15) has a pivot range (P) specifying the length of the stroke between the first reversing position or rest position (UA) and the second reversing position (UB) of the common tool carrier (14), whereby a required overlift (Z) is minimized.

2. The device of claim 1, characterized in that the separate rotary drive (30) comprises a second electric motor (31) that is in operative connection with the rotating part (24) without the interposition of a transmission gear or reduction gear (2).

3. The device of claim 2, characterized in that the second electric motor (31) is a segment motor or a torque motor or a servomotor.

4. The device of claim 1, characterized in that the control unit (19) is disposed further to control by separately specifying a chronological progression of the intermittent movement of rotation of the rotating part (24) and a chronological progression of the intermittent reciprocating movement (H) of the tool carrier (14).

5. The device of claim 1, characterized in that the transport device (23) further comprises a position sensor (33) operatively disposed to detect a position of rotation ($\alpha_i$) of the rotating part (24).

6. The device of claim 5, characterized in that the transport device (23) in operative arrangement with the control unit (19) further disposed to control at least one of the position and the angular velocity ($\omega$) and the angular acceleration and the acceleration change of the rotating part (24).

7. The device of claim 1, characterized in that the control unit (19) is disposed to control a rest phase (R) while the tool carrier (14) is stopped which is at least as long as a transport phase (T) that is controlled by the control unit (19) and required by the rotary drive (30) for rotating the rotating part (24) between two successive, specified positions of rotation ($\alpha_i$, $\alpha_{i+1}$).

8. The device of claim 7, characterized in that the duration of the transport phase (T) required by the rotary drive (30) for rotating the rotating part (24) between two successive, specified positions of rotation ($\alpha_i$, $\alpha_{i+1}$) is adjustable.

9. A method for operating a device (10) for forming hollow cylindrical bodies (11), the device (10) comprises a common tool carrier (14) with a plurality of stations (12) that are arranged along a circular orbit and comprise, respectively, one tool (13), wherein the tools (13) are arranged on the common tool carrier (14), a main drive (15) in operative arrangement with the common tool carrier (14), the main drive (15) comprises a first electric motor or servomotor (18) that reverses its turning direction in a first reversing position or rest position (UA), a transport device (23) including a rotating part (24), a separate rotary drive (30) in operative arrangement with the rotating part (24), the method comprises the following steps:

initiating an intermittent reciprocating movement (H) of the tool carrier (14) between the first reversing position or rest position (UA) and a second reversing position (UB), transporting the hollow cylindrical bodies (11) by the rotating part (24) between the stations (12) along a circular orbit (K), controlling the first electric motor or servomotor (18) of the main drive (15) in a pivot operation, wherein the main drive (15) has a pivot range (P) specifying the length of the stroke between the first reversing position or rest position (UA) and the second reversing position (UB), moving the tool carrier (14) into the rest position (UA) via the main drive (15) before starting of an intermittent rotating movement of the rotating part (24) and stopping the tool carrier (14) in the rest position (UA), subsequently, initiating the intermittent rotating movement of the rotating part (24) via the rotary drive (30), and, starting the reciprocating movement (H) of the tool carrier (14) out of the rest position (UA) only after the intermittent rotating movement of the rotating part (24) is completed.

* * * * *